US005976747A

United States Patent [19]

Sato et al.

[11] Patent Number: 5,976,747

[45] Date of Patent: Nov. 2, 1999

[54] FERRITE CARRIER FOR ELECTROPHOTOGRAPHIC DEVELOPER AND ELECTROPHOTOGRAPHIC DEVELOPER CONTAINING THE SAME

[75] Inventors: Yuji Sato; Tsuyoshi Itagoshi; Kazunori Takagi; Norio Takei; Toshio Honjo, all of Chiba-ken, Japan

[73] Assignee: Powdertech Co., Ltd., Chiba-Ken, Japan

[21] Appl. No.: 09/030,804

[22] Filed: Feb. 26, 1998

[30] Foreign Application Priority Data

Jan. 8, 1998 [JP] Japan ..... 10-002193

[51] Int. Cl.[6] ..... G03G 9/107

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 4,977,054 | 12/1990 | Honjo et al. . | |
| 5,595,850 | 1/1997 | Honjo et al. | 430/106.6 |
| 5,693,444 | 12/1997 | Takagi et al. | 430/106.6 |
| 5,789,129 | 8/1998 | Ochiai et al. | 430/106.6 |
| 5,795,693 | 8/1998 | Okado et al. | 430/106.6 |

FOREIGN PATENT DOCUMENTS

| | | |
|---|---|---|
| 0 691 582 | 1/1996 | European Pat. Off. . |
| 0 780 734 | 6/1997 | European Pat. Off. . |
| 1 771 987 | 3/1972 | Germany . |
| 58-123552 | 7/1983 | Japan . |
| 58-215664 | 12/1983 | Japan . |
| 59-111159 | 6/1984 | Japan . |
| 60-227267 | 11/1985 | Japan . |
| 61-200551 | 9/1986 | Japan . |
| 62-297856 | 12/1987 | Japan . |
| 62-297857 | 12/1987 | Japan . |
| 6-110253 | 4/1994 | Japan . |
| 7-20658 | 1/1995 | Japan . |
| 8-22150 | 1/1996 | Japan . |

OTHER PUBLICATIONS

Chemical Abstracts 114:72615, 1991.

Diamond, Arthur S. (editor) Handbook of Imaging Materials. New York: Marcel–Dekker, Inc. pp. 201–215 & 222–225, 1991.

*Primary Examiner*—Christopher D. Rodee

*Attorney, Agent, or Firm*—Young & Thompson

[57] ABSTRACT

A ferrite carrier for electrophotographic developers which is represented by formula:

$$(MnO)_x(MgO)_y(Fe_2O_3)_z$$

wherein x+y+z=100 mol %, and part of MnO, MgO and/or $Fe_2O_3$ is substituted with $SnO_2$, and has a saturation magnetization of 20 to 43 emu/g.

8 Claims, 3 Drawing Sheets

FERRITE CARRIER FOR ELECTROPHOTOGRAPHIC DEVELOPER AND ELECTROPHOTOGRAPHIC DEVELOPER CONTAINING THE SAME

BACKGROUND OF THE INVENTION

1. Field of the Invention

This invention relates to a ferrite carrier for two-component electrophotographic developers used in copying machines, printers, and the like.

2. Description of Related Art

A two-component developer used for developing an electrostatic latent image in electrophotography comprises a toner and a carrier. The carrier is mixed and agitated with the toner in a development box to give a desired charge to the toner and carries the charged toner onto an electrostatic latent image formed on a photosensitive material (photoreceptor) to form a toner image.

The carrier remains on the magnet and is returned to the development box where it is again mixed and agitated with fresh toner particles for repeated use.

In order to obtain high image quality over a service life of a developer in a stable manner, the carrier is required to have stable characteristics over the life.

In the recent two-component development system, soft ferrite carriers have been replacing conventionally used oxide-coated iron powder or resin-coated iron powder to provide high quality images and to have a long life. Soft ferrites, typically represented by formula: $MO_aM'O_b(Fe_2O_3)c$ (wherein M and M' each represent a metal element; and a, b and c are each an integer), include Ni-Zn ferrites, Cu-Zn ferrites, and Cu-Zn-Mg ferrites.

Compared with conventional iron powder carriers, the soft ferrite carriers possess many advantageous characters for securing high image quality and a long life. However, use of such metals as Ni, Cu and Zn has recently come to be avoided under strict environmental restrictions.

While the conventional iron powder or magnetite carriers are environmentally benign, giving no adverse influences to the environment, it is difficult with these carriers to enjoy image quality and a life comparable to those of the above-mentioned ferrite carriers.

In the ferrite carriers proposed to date are also included Li-Mn ferrites as disclosed in Japanese Patent Laid-Open Nos. 215664/83 and 297857/87; Mn-Mg ferrites as disclosed in Japanese Patent Laid-Open Nos. 123552/83 and 111159/84; and Mn-Mg-Sr ferrites as described in Japanese Patent Laid-Open No. 22150/96. Lithium in the Li-Mn ferrites, however, is liable to be affected by the surrounding conditions, such as temperature and humidity, and greatly vary in properties. The state-of-the-art Mn-Mg ferrites are unsatisfactory similarly to the other conventional ferrite carriers in that the problem of reducing variation of magnetization among carrier particles still remains unsolved. An Mn-Mg-Sr ferrite carrier has been proposed as a solution to the above problem but has difficulty in achieving uniformity of surface properties (the degree of grain boundary growth), which causes great variation of characteristics when it is used as coated with a resin.

In recent years a so-called soft development system using a low saturation magnetization carrier has been introduced to obtain images of high quality. In this connection it is difficult with the Mn-Mg-Sr ferrite to stably produce a low saturation magnetization carrier.

Japanese Patent Laid-Open Nos. 227267/85, 200551/86, 297856/87, 297857/87, 110253/94, and 20658/95 propose addition of metals, such as V, As, Bi, Sb, Pb, Cu, B, Sn, Si, Li, and P, or oxides, carbonates or sulfates thereof as a resistivity regulator or a sintering aid for ferrite carriers. However, none of these additives was found effective in reducing variation of magnetization among particles, producing a low saturation magnetization carrier stably, and making the carrier surface uniform.

SUMMARY OF THE INVENTION

An object of the present invention is to provide a ferrite for use as a carrier of electrophotographic developers which can stably provide a low saturation magnetization carrier applicable to a soft development system or a carrier with small variation of magnetization among particles and uniform surface properties for assuring stabilization of characteristics after resin coating.

Another object of the present invention is to provide an electrophotographic developer containing the ferrite carrier being capable of forming images of high quality, having excellent durability, giving no adverse influences to the environment, and having a long life and stability against surrounding conditions.

The inventors of the present invention have conducted extensive study to solve the above-described problems. They found as a result that the above object is accomplished by substituting part of an Mn-Mg ferrite having a specific composition with a specific amount of stannic oxide ($SnO_2$). The present invention has been completed based on this finding.

The present invention provides a ferrite carrier for electrophotographic developers which is represented by formula:

$$(MnO)_x(MgO)_y(Fe_2O_3)_z$$

wherein x+y+z=100 mol %, and part of MnO, MgO and/or $Fe_2O_3$ is substituted with $SnO_2$, and has a saturation magnetization of 20 to 43 emu/g.

According to the present invention, a carrier having a low magnetization saturation can be obtained stably, magnetization variation among carrier particles is reduced, and carrier particles having uniform surface properties are obtained. Therefore, the ferrite carrier of the present invention is applicable to a soft development system and exhibits stabilized characteristics against resin coating. The electrophotographic developer containing the ferrite carrier of the present invention is capable of forming images of high quality, has excellent durability, gives no adverse influences to the environment, and has a long life and excellent environmental stability.

DETAILED DESCRIPTION OF THE INVENTION

Figure 1:
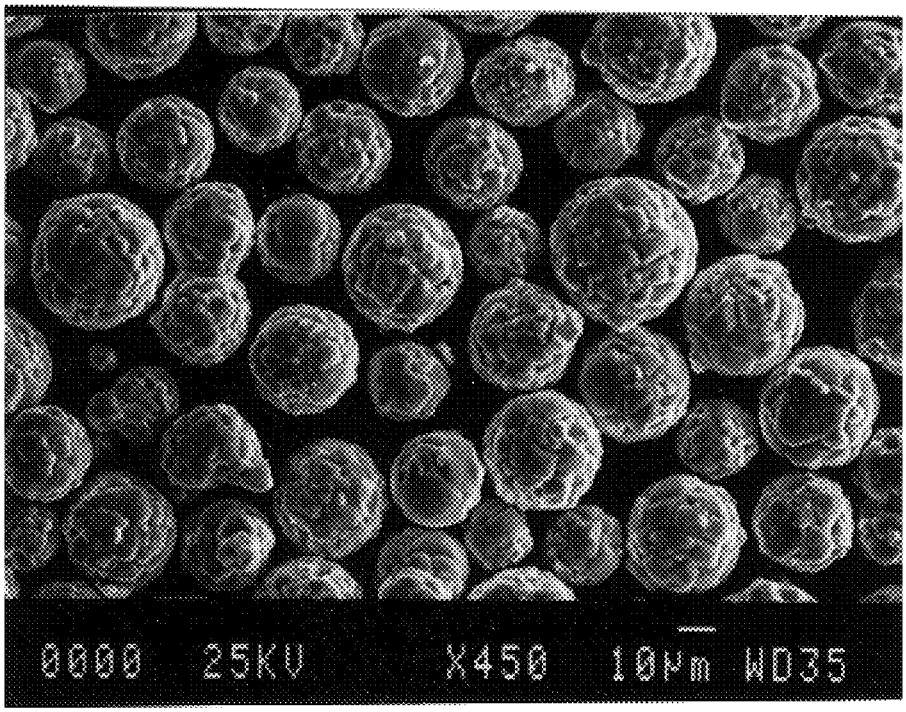
FIG. 1 is an electron micrograph (×450) showing the surface of the ferrite carrier particles obtained in Example 1.

The present invention will now be described hereunder in detail.

The ferrite carrier for electrophotographic developers according to the present invention basically has the following formula:

$$(MnO)_x(MgO)_y(Fe_2O_3)_z$$

wherein x+y+z=100 mol %.

As a basic composition it is preferred that x, y, and z be 5 to 35 mol %, 10 to 45 mol %, and 45 to 55 mol %, respectively. It is still preferred that x, y, and z be 7.5 to 12.5 mol %, 35 to 45 mol %, and 45 to 55 mol %, respectively.

In the present invention, part of MnO, MgO and $Fe_2O_3$ is substituted with $SnO_2$. The amount of substituting $SnO_2$ preferably ranges from 0.5 to 5.0mol %, particularly 0.5 to 3.0mol %. If it is less than 0.5 mol %, sufficient uniformity of surface properties cannot be obtained. If it exceeds 5.0 mol %, the ferrite has an extremely reduced saturation magnetization and is hardly useful as a carrier of a two-component developer. With the amount of substituting $SnO_2$ falling within the range of from 0.5 to 5.0 mol %, a low saturation magnetization carrier can be obtained in a stable manner, which makes the ears of a magnetic brush soft, permitting soft development. Further, there is obtained a carrier with uniform surface properties, which makes it possible to stabilize the characteristics after resin coating. Furthermore, there is obtained an electrophotographic developer containing a ferrite carrier which is capable of forming images of high quality, has excellent durability, gives no adverse influences to the environment, and has a long life and environmental stability.

The ferrite carrier of the present invention preferably has an average particle diameter of about 15 to 200 μm, particularly 20 to 100 μm.

The ferrite carrier according to the present invention has a saturation magnetization of 20 to 43 emu/g, preferably 25 to 43 emu/g. A saturation magnetization less than 20 emu/g is insufficient for use as a carrier for two-component developers. If the saturation magnetization exceeds 43 emu/g, the carrier is hardly applicable to a soft development system.

A method for producing the ferrite carrier of the present invention is described hereunder briefly.

MnO, MgO, $Fe_2O_3$, and $SnO_2$ are compounded in amounts of 5 to 35 mol %, 10 to 45 mol %, 45 to 55 mol %, and 0.5 to 5.0 mol %, respectively. The resulting mixture of oxides is wet or dry ground in a ball mill, a sand mill, a vibration mill, etc. for at least 1 hour, preferably 1 to 20 hours. The grounds are granulated and calcined at 700 to 1200° C. The calcination may be omitted in some cases. The calcined granules are further wet ground in a wet ball mill, a wet sand mill, a wet vibration mill, etc. to an average particle diameter of 15 μm or smaller, preferably 5 μm or smaller, still preferably 2 μm or smaller. If desired, a dispersing agent, a binder and the like are added to the slurry. After viscosity adjustment, the slurry is granulated and fired at a firing temperature of 1000 to 1500° C., preferably 1200 to 1500° C., for a period of 1 to 24 hours.

Conventional ferrite carriers greatly vary in degree of growth of grain boundaries on their surface depending on the firing temperature, which has been a cause of difficulty in regulating the surface properties. In contrast, it is easy for the Mn-Mg-Sn ferrite carrier according to the present invention to have uniform surface properties as long as the firing temperature is 1200° C. or higher. It is known that saturation magnetization and electrical resistance of ferrite carriers can be adjusted by control of a firing atmosphere. As for the Mn-Mg-Sn ferrite carrier of the present invention, while the electrical resistance is adjusted through control on the firing atmosphere, a saturation magnetization stably falls within a range of from 20 to 43 emu/g irrespective of the firing atmosphere, i.e., whether the firing is carried out in the atmosphere or an oxygen-free atmosphere. The resulting firing product is disintegrated and classified to obtain particles of desired size.

The Mn-Mg-Sn ferrite particles thus obtained are usually coated with a resin. Resins to be used for coating the ferrite core are not particularly limited and include various known resins. For example, resins applicable to positively chargeable toners include fluororesins, fluoroacrylic resins, silicone resins, and modified silicone resins, with silicone resins of condensation type being preferred. Resins usable for negatively chargeable toners include acrylate-styrene resins, mixed resins of an acrylate-styrene resin and a melamine resin and hardened resins thereof, silicone resins, modified silicone resins, epoxy resins, polyester resins, urethane resins, and polyethylene resins, with acrylate-styrene resin/melamine resin mixed resins or hardened resins thereof and silicone resins of condensation type being preferred. If necessary, additives, such as a charge control agent, an adhesion improving agent, a priming agent, and a resistance control agent, can be added to the coating resin.

The amount of the resin to be applied to the ferrite core is preferably from 0.05 to 10.0% by weight, particularly 0.1 to 7.0% by weight based on the core. The effects of the Mn-Mg-Sn ferrite carrier of the present invention are manifested particularly when the amount of the coating resin is small. This is because the uniform surface of the ferrite core permits the resin to be applied evenly thereby to reduce variability among carrier particles or from lot to lot.

In a typical method of resin coating, a resin is diluted with a solvent and then applied on the surface of the ferrite core. Diluting solvents for organic solvent-soluble resins include toluene, xylene, butyl cellosolve acetate, methyl ethyl ketone, methyl isobutyl ketone, and methanol. Water can be used as a diluting solvent for water-soluble resins or emulsion resins. The resin diluted with the solvent is applied to the ferrite core by dip coating, spray coating, brush coating or kneading. The solvent is volatilized thereafter. In place of such a wet coating technique using a solvent, a dry coating method may be adopted, in which a powdered resin is applied to the surface of the ferrite core.

Where the resin-coated ferrite core is baked, baking can be carried out by either external heating or internal heating. For example, a fixed-bed or fluidized-bed electric furnace, a rotary electric furnace or a burner furnace can be used. Microwave heating can also be used. The baking temperature, which varies depending on the resin used, should be the melting point or glass transition point of the resin at the lowest. Where a thermosetting resin or a condensation resin is used, the baking temperature should be raised to such a level at which the resin cures sufficiently.

The ferrite core coated with the resin and baked is cooled, disintegrated, and adjusted to have a desired particle size to obtain a resin-coated ferrite carrier.

The ferrite carrier of the present invention is mixed with a toner for use as a two-component developer. The toner used herein comprises a binder resin having dispersed therein a coloring agent and the like.

While not limiting, the binder resin to be used in the toner includes polystyrene, chlorinated polystyrene, styrene-chlorostyrene copolymers, styrene-acrylic ester copolymers, styrene-methacrylic acid copolymers, rosin-modified maleic acid resins, epoxy resins, polyester resins, polypropylene resins, and polyurethane resins. These resins may be used either individually or as a combination thereof.

The charge control agent is arbitrarily selected from suitable ones. Those for positively chargeable toners include nigrosine dyes and quaternary ammonium salts. Those for negatively chargeable toners include metallized monoazo dyes.

The coloring agents used herein can be conventional dyes or pigments, such as carbon black, Phthalocyanine Blue, Permanent Red, chrome yellow, and Phthalocyanine Green. In addition, external additives, such as fine silica powder and titania, can be added to the toner particles to improve fluidity or prevent agglomeration.

The method for producing the toner is not particularly limited. For example, the toner can be obtained by thoroughly blending a binder resin, a charge control agent, and a coloring agent in a mixer, e.g., a Henschel mixer, melt-kneading the blend in, e.g., a twin-screw extruder, cooling, grinding, classifying, and compounding external additives by mixing in a mixer, etc.

The present invention will be illustrated in greater detail by way of Examples.

EXAMPLES 1 TO 3

A mixture of 10 mol % of MnO, 39 mol % of MgO, 50 mol % of $Fe_2O_3$, and 1 mol % of $SnO_2$ was wet ground in a ball mill. After drying, the grinds were calcined at 850° C. for 1 hour. The calcined product was wet ground in a ball mill into particles of 3 $\mu$m or smaller. To the resulting slurry were added adequate amounts of a dispersing agent and a binder. The slurry was granulated and dried by means of a spray drier.

The granules were fired at 1200° C. for 4 hours in an electric furnace under the atmosphere. The fired product was disintegrated and classified to obtain ferrite core particles having an average particle diameter of 35 $\mu$m.

The ferrite core particles were coated with 1.3% by weight of a modified silicone resin diluted with toluene on a fluidized bed and then baked at 200° C. for 3 hours to obtain a resin-coated ferrite carrier (Example 1).

The procedure of Example 1 was followed to obtain resin-coated ferrite carriers, except that the firing of the granules was carried out in an atmosphere having an oxygen concentration of 3% or 0% (Examples 2 and 3).

EXAMPLES 4,6, and 7

Resin-coated Mn-Mg-Sn ferrite carriers were obtained in the same manner as in Example 1, except for changing the mixing ratio of MnO, MgO, $Fe_2O_3$, and $SnO_2$ as shown in Table 1 below.

COMPARATIVE EXAMPLE 1

A resin-coated Mn-Mg ferrite carrier containing no $SnO_2$ was obtained in the same manner as in Example 1, except for using 10 mol % of MnO, 40 mol % of MgO, and 50 mol % of $Fe_2O_3$.

COMPARATIVE EXAMPLE 2

A resin-coated Mn-Mg ferrite carrier containing SrO in place of $SnO_2$ was obtained in the same manner as in Example 1, except for using 10 mol % of MnO, 39 mol % of MgO, 50 mol % of $Fe_2O_3$, and 1 mol % of SrO.

COMPARATIVE EXAMPLES 3 TO 6

The procedure of Example 1 was followed, except for replacing $SnO_2$ with 1 mol % of $SiO_2$, $PbO_2$, $Bi_2O_3$ or $Al_2O_3$, to obtain a resin-coated Mn-Mg ferrite carrier containing $SiO_2$ (Comparative Example 3), $PbO_2$ (Comparative Example 4), $Bi_2O_3$ (Comparative Example 5) or $Al_2O_3$ (Comparative Example 6).

COMPARATIVE EXAMPLES 7 TO 8

Granules were prepared in the same manner as in Example 1, except for using 39 mol % of MnO, 10 mol % of MgO, 50 mol % of $Fe_2O_3$, and 1 mol % of SrO.

The resulting granules were fired at 1200° C. for 4 hours in an electric furnace under the atmosphere, disintegrated, and classified to obtain ferrite core particles having an average particle diameter of 35 $\mu$m. The core particles were coated with a resin in the same manner as in Example 1 to obtain a resin-coated ferrite carrier (Comparative Example 7).

The above procedure was followed, except that the firing was performed in an electric furnace having no oxygen content, to obtain a resin-coated ferrite carrier (Comparative Example 8).

COMPARATIVE EXAMPLE 9

A resin-coated Cu-Zn ferrite carrier containing no $SnO_2$ was obtained in the same manner as in Example 1, except for using 20 mol % of CuO, 25 mol % of ZnO, and 55 mol % of $Fe_2O_3$.

COMPARATIVE EXAMPLE 10

A resin-coated Ni-Zn ferrite carrier containing no $SnO_2$ was obtained in the same manner as in Example 1, except for using 13 mol % of NiO, 37 mol % of ZnO, and 50 mol % of $Fe_2O_3$.

The saturation magnetization of the ferrite carriers obtained in Examples 1–4, 6 and 7 and Comparative Examples 1 to 10 was measured. Further, the ferrite carriers were tested to determine the amount scattered. Furthermore, the surface of the carrier particles was observed under a scanning electron microscope.

The amount of the carrier scattered was determined as follows. A sample carrier weighing 600 g was put in a development box of a copying machine and agitated at 158 rpm for 10 minutes by means of a motor. The particles scattered out of the development box were collected and weighed. Further, the saturation magnetization of the scattered particles was measured at 3 KOe. Variation of magnetization was evaluated by a Y/X ratio wherein X is the saturation magnetization of the carrier before testing; and Y is the magnetization of the scattered carrier particles.

Figure 2:
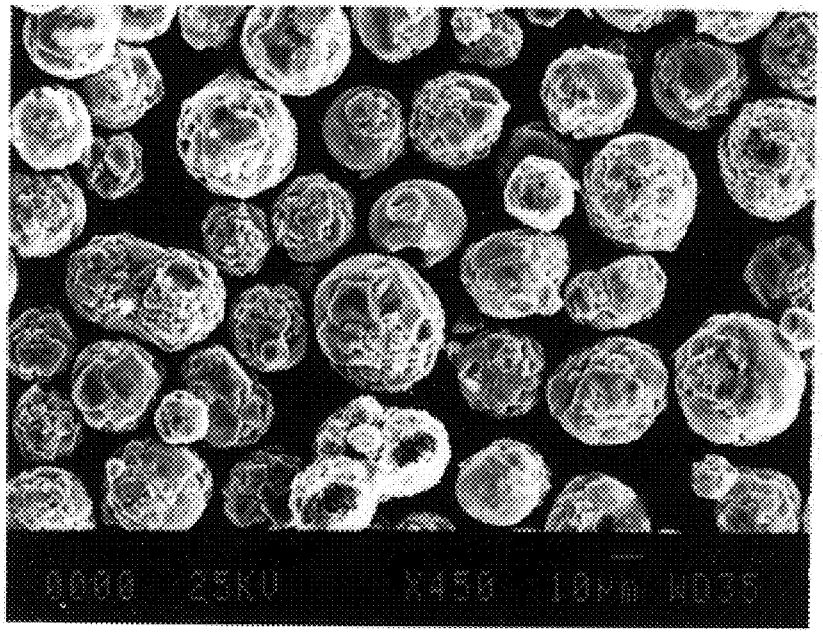
FIG. 2 is an electron micrograph (×450) showing the surface of the ferrite carrier particles obtained in Comparative Example 1.
Figure 3:
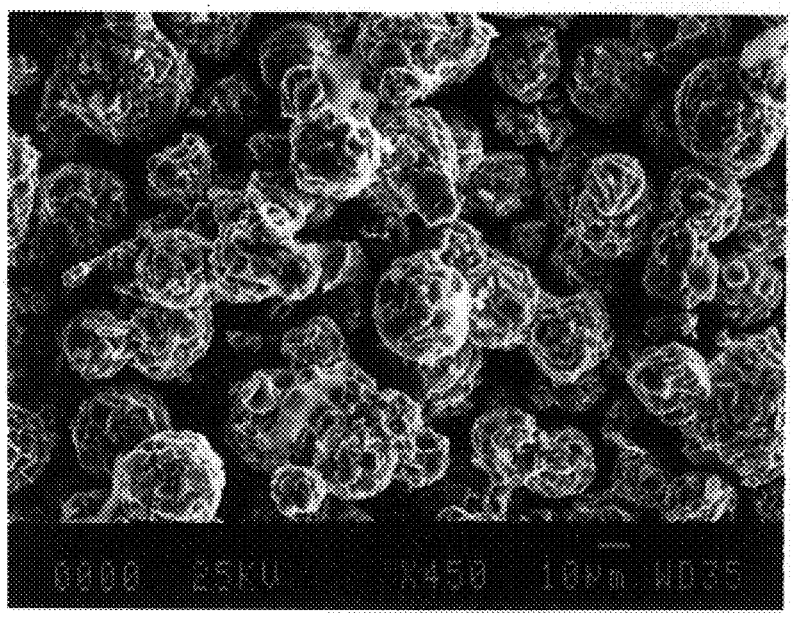
FIG. 3 is an electron micrograph (×450) showing the surface of the ferrite carrier particles obtained in Comparative Example 6.

The results of the measurements are shown in Table 1, and the electron micrographs of Example 1 and Comparative Examples 1 and 6 are shown in FIGS. 1 through 3.

Figure 4:
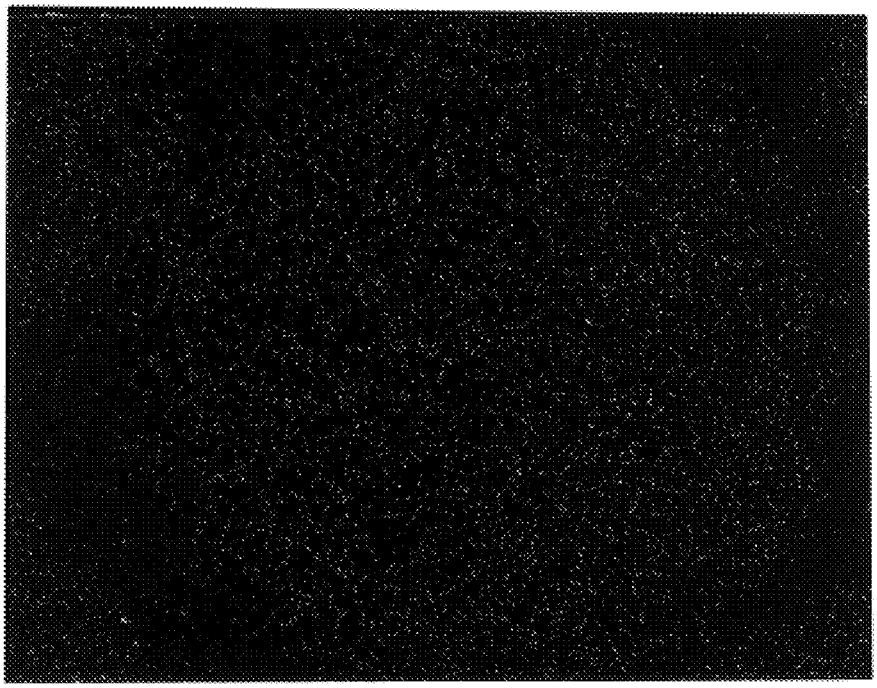
FIG. 4 is an EPMA photograph (×2000) of the cross section of the ferrite carrier particle obtained in Example 1.
Figure 5:
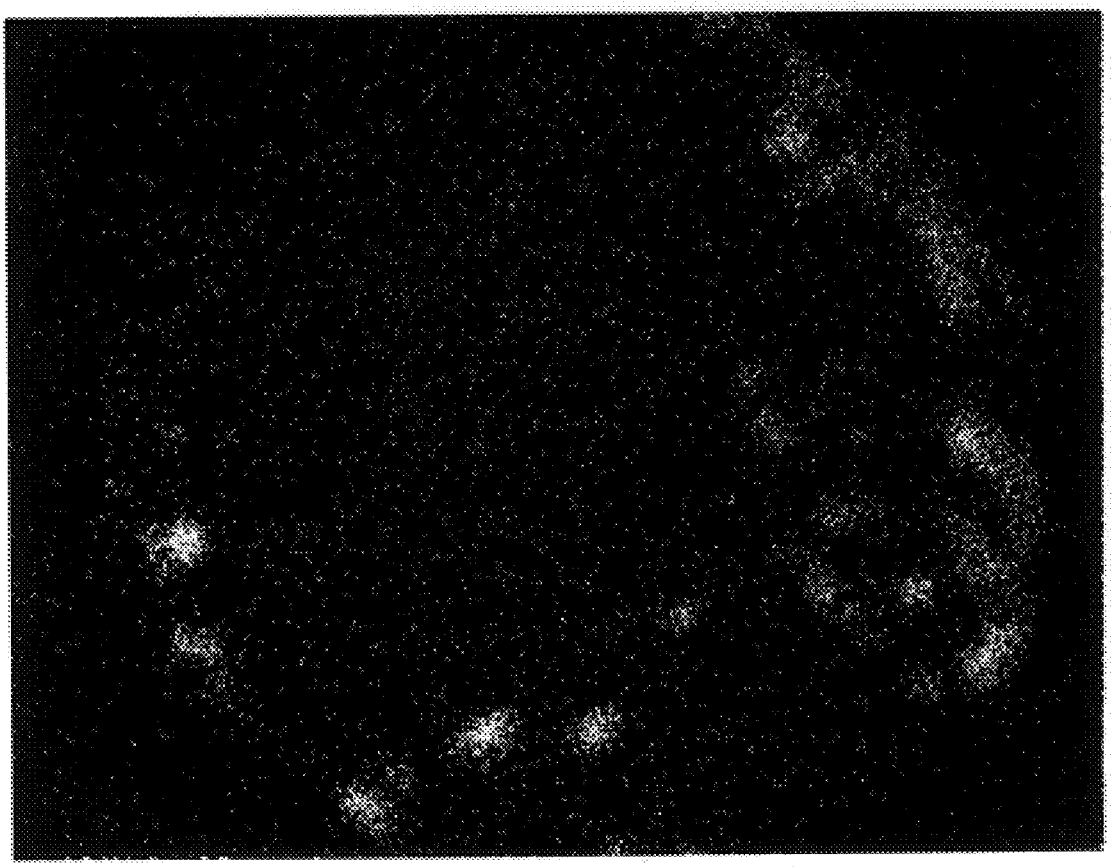
FIG. 5 is an EPMA photograph (×2000) of the cross section of the ferrite carrier particle obtained in Comparative Example 6.

The cut section of the carrier obtained in Example 1 and Comparative Example 6 was examined by means of an electron probe microanalyzer (EPMA) to analyze the substituting element, Sn (Example 1) or Bi (Comparative Example 6). The results obtained are shown in FIGS. 4 and 5.

TABLE 1

| Example No. | Composition (mol %) $Fe_2O_3$ | MnO | MgO | CuO | ZnO | NiO | $SnO_2$ | SrO | $SiO_2$ | $PbO_2$ | $Al_2O_3$ | $Bi_2O_3$ | Firing Atm. ($O_2$ Concn.) | Sat. Magn. (emu/g) Before Test (X) | Scattered (Y) | Y/X |
|---|---|---|---|---|---|---|---|---|---|---|---|---|---|---|---|---|
| Ex. 1 | 50.0 | 10.0 | 39.0 | | | | 1.0 | | | | | | atm. | 35 | 35 | 1.000 |
| Ex. 2 | 50.0 | 10.0 | 39.0 | | | | 1.0 | | | | | | 3.0% | 38 | 38 | 1.000 |
| Ex. 3 | 50.0 | 10.0 | 39.0 | | | | 1.0 | | | | | | 0.0% | 39 | 39 | 1.000 |
| Ex. 4 | 50.0 | 10.0 | 39.5 | | | | 0.5 | | | | | | atm. | 32 | 32 | 1.000 |
| Ex. 6 | 50.0 | 5.0 | 44.0 | | | | 1.0 | | | | | | atm. | 29 | 27 | 0.931 |
| Ex. 7 | 55.0 | 35.0 | 9.0 | | | | 1.0 | | | | | | atm. | 24 | 22 | 0.917 |
| Comp. Ex. 1 | 50.0 | 10.0 | 40.0 | | | | | | | | | | atm. | 34 | 20 | 0.588 |
| Comp. Ex. 2 | 50.0 | 10.0 | 39.0 | | | | | 1.0 | | | | | atm. | 38 | 37 | 0.974 |
| Comp. Ex. 3 | 50.0 | 10.0 | 39.0 | | | | | | 1.0 | | | | 0.0% | 35 | 2 | 0.057 |
| Comp. Ex. 4 | 50.0 | 10.0 | 39.0 | | | | | | | 1.0 | | | atm. | 34 | 21 | 0.618 |
| Comp. Ex. 5 | 50.0 | 10.0 | 39.0 | | | | | | | | | 1.0 | atm. | 37 | 25 | 0.676 |
| Comp. Ex. 6 | 50.0 | 10.0 | 39.0 | | | | | | | | 1.0 | | atm. | 36 | 35 | 0.972 |
| Comp. Ex. 7 | 55.0 | 35.0 | 9.0 | | | | 1.0 | | | | | | atm. | 50 | 49 | 0.980 |
| Comp. Ex. 8 | 55.0 | 35.0 | 9.0 | | | | 1.0 | | | | | | 0.0% | 70 | 69 | 0.986 |
| Comp. Ex. 9 | 55.0 | | | 20.0 | 25.0 | | | | | | | | atm. | 60 | 53 | 0.883 |
| Comp. Ex. 10 | 50.0 | | | | 37.0 | 13.0 | | | | | | | atm. | 49 | 35 | 0.714 |

The following observations can be made on the results in Table 1. Evaluated in the light of the Y/X ratio, the Mn-Mg-Sn ferrite carriers of Examples 1 to 7 are seen to suffer less reduction in saturation magnetization when scattered than those of Comparative Examples 1, 3 to 5 and 9 to 10. It is also seen that the variation of saturation magnetization depending on the composition or the firing atmosphere as observed in Examples is less than that observed in Comparative Examples 2, 7 and 8, in which the scattered ferrite particles show small reduction in saturation magnetization. As is apparent from FIGS. 1 to 3, Example 1 is superior to Comparative Examples 1 and 6 in uniformity of the carrier surface. The uniformity reduces in the order of Example 1, Comparative Example 1 and Comparative Example 6. While not shown, the electron micrographs of Examples 2–4, 6, and 7 and Comparative Examples 9 and 10 showed similarity in surface properties to that of Example 1, those of Comparative Examples 3 to 5 to that of Comparative Example 1, and those of Comparative Examples 2, 7 and 8 to that of Comparative Example 6.

It is clearly seen from FIGS. 4 and 5 that the substituting element exhibits excellent dispersibility in the matrix as compared with Comparative Example 6.

EXAMPLES 8 TO 13

Three lots of the ferrite core particles obtained in Example 1 were each coated with 0.3% or 1.3% by weight of a modified silicone resin diluted with toluene on a fluidized bed and baked at 200° C. for 3 hours to obtain modified silicone resin-coated ferrite carriers.

COMPARATIVE EXAMPLES 11 TO 16

Three lots of the ferrite core particles obtained in Comparative Example 6 were each coated with a modified silicone resin in the same manner as in Examples 8 to 13 to obtain resin-coated ferrite carriers.

A voltage of 200 V was applied to each of the resin-coated Mn-Mg-Sn or Mn-Mg-Bi ferrite carriers obtained in Examples 8 to 13 and Comparative Examples 11 to 16, and the current was measured. Further, the carrier was mixed with a commercially available negatively chargeable toner to prepare a developer having a toner content of 8 wt %, and the quantity of charges was determined by a blow-off method. The results obtained are shown in Table 2 below. The standard deviation calculated from these measured values was taken as a measure of lot-to-lot variation.

TABLE 2

| Example No. | Core Lot | Amount of Resin (wt %) | Current (μA) Measured Values | Variation | Quantity of Charges (μC/g) Measured Values | Variation |
|---|---|---|---|---|---|---|
| Ex. 8 | Ex. 1-1 | 0.3 | 7.2 | 0.115 | 29.4 | 1.127 |
| Ex. 9 | Ex. 1-2 | 0.3 | 7.2 | | 27.5 | |
| Ex. 10 | Ex. 1-3 | 0.3 | 7.4 | | 29.5 | |
| Ex. 11 | Ex. 1-1 | 1.3 | 3.5 | 0.100 | 25.3 | 1.493 |
| Ex. 12 | Ex. 1-2 | 1.3 | 3.7 | | 24.8 | |
| Ex. 13 | Ex. 1-3 | 1.3 | 3.6 | | 22.5 | |
| Comp. Ex. 11 | Comp. Ex. 6-1 | 0.3 | 10.6 | 2.228 | 33.6 | 2.098 |
| Comp. Ex. 12 | Comp. Ex. 6-2 | 0.3 | 14.3 | | 30.5 | |
| Comp. Ex. 13 | Comp. Ex. 6-3 | 0.3 | 14.6 | | 29.6 | |
| Comp. Ex. 14 | Comp. Ex. 6-1 | 1.3 | 5.1 | 0.551 | 27.8 | 1.877 |
| Comp. Ex. 15 | Comp. Ex. 6-2 | 1.3 | 4.0 | | 24.1 | |
| Comp. Ex. 16 | Comp. Ex. 6-3 | 1.3 | 4.5 | | 26.5 | |

As is apparent from Table 2, although Examples 8 to 13 are seen to increase the current as the amount of the coating resin decreases, the lot-to-lot variation in current is unchanged whether the amount of the coating resin is 0.3% or 1.3%. The same observation applies to the quantity of charges. In other words, the characteristics after resin coating are stabilized as compared with Comparative Examples 11 to 16.

What is claimed is:

1. A ferrite carrier for an electrophototraphic developer, the carrier having a saturation magnetization of 20 to 43 emu/g and being represented by $(MnO)_x(MgO)_y(Fe_2O_3)_z$, wherein x+y+z=100 mol %, wherein x is 5 to 12.5 mol %, y is 35 to 45 mol %, and z is 45 to 55 mol %, and wherein $Sno_2$ replaces part of at least one of the MnO, MgO, and $Fe_2O_3$ wherein the total $SnO_2$ is 0.5 to 3 mol %.

2. The ferrite carrier of claim 1, wherein the total $SnO_2$ is 0.5 to 1 mol %.

3. The ferrite carrier of claim 2, wherein x is 10 mol %, y is 39 to 39.5 mol %, and z is 50 mol %.

4. The ferrite carrier of claim 1, further comprising a resin coating on a surface of the carrier.

5. An electrophotographic developer comprising a toner and a ferrite carrier, said carrier having a saturation magnetization of 20 to 43 emulg and being represented by $(Mno)_x(Mgo)_y(Fe_2O_3)_z$, wherein x+y+z=100 mol %, wherein x is 5 to 12.5 mol %, y is 35 to 45 mol %, and z is 45 to 55 mol %, and wherein $SnO_2$ replaces part of at least one of the MnO, MgO, and $Fe_2O_3$ wherein the total $SnO_2$ is 0.5 to 3 mol %.

6. The developer of claim 5, wherein the total $SnO_2$ is 0.5 to 1 mol %.

7. The developer of claim 6, wherein x is 10 mol %, y is 39 to 39.5 mol %, and z is 50 mol %.

8. The developer of claim 5, further comprising a resin coating on a surface of the carrier.

* * * * *